US006270624B1

(12) United States Patent
Huovila et al.

(10) Patent No.: US 6,270,624 B1
(45) Date of Patent: Aug. 7, 2001

(54) STOCK FEED SYSTEM FOR A MULTI-LAYER HEADBOX AND METHOD IN THE OPERATION OF A MULTI-LAYER HEADBOX

(75) Inventors: Jyrki Huovila, Muurame; Erkki Ilmoniemi, Vaajakoski; Michael Odell; Antti Suonperä , both of Jyväskylä, all of (FI)

(73) Assignee: Valmet Paper Machinery Inc., Helsinki (FI)

( * ) Notice: Subject to any disclaimer, the term of this patent is extended or adjusted under 35 U.S.C. 154(b) by 0 days.

(21) Appl. No.: 08/323,839

(22) Filed: Oct. 17, 1994

(30) Foreign Application Priority Data

Oct. 29, 1993 (FI) ..... 934793

(51) Int. Cl.[7] ..... D21F 1/00; D21F 11/00

(52) U.S. Cl. ..... 162/127; 162/123; 162/128; 162/183; 162/298; 162/300; 162/301; 162/322; 162/336

(58) Field of Search ..... 162/343, 336, 162/380, 216, 123, 124, 125, 127, 128, 183, 190, 203, 299, 301, 298, 322

(56) References Cited

U.S. PATENT DOCUMENTS

| | | | | |
|---|---|---|---|---|
| 2,077,017 | * | 4/1937 | Schacht | 162/125 |
| 2,315,892 | | 4/1943 | Booth | 92/21 |
| 3,266,974 | * | 8/1966 | Staver, Jr. | 162/216 |
| 3,598,696 | * | 8/1971 | Beck | 162/343 |
| 3,833,465 | * | 9/1974 | Campbell | 162/129 |
| 4,021,295 | | 5/1977 | Schmaeng | 162/125 |
| 4,086,130 | * | 4/1978 | Justus | 162/343 |
| 4,384,922 | * | 5/1983 | Stotz | 162/343 |
| 4,445,974 | * | 5/1984 | Stenberg | 162/300 |
| 4,744,866 | * | 5/1988 | Koponen et al. | 162/203 |
| 4,889,594 | * | 12/1989 | Gavelin | 162/190 |
| 5,074,965 | * | 12/1991 | Keskiivari et al. | 162/216 |
| 5,401,363 | * | 3/1995 | Begemann et al. | 162/343 |
| 5,405,501 | * | 4/1995 | Phan et al. | 162/127 |
| 5,466,340 | * | 11/1995 | Begemann et al. | 162/336 |

FOREIGN PATENT DOCUMENTS 3720618 1/1988 (DE) .

* cited by examiner

*Primary Examiner*—Richard Crispino
(74) *Attorney, Agent, or Firm*—Steinberg & Raskin, P.C.

(57) ABSTRACT

A stock feed system for a multi-layer headbox and a method in the operation of a multi-layer headbox in which into each inlet header of the multi-layer headbox, a stock concept is passed which has been produced out of the same fresh stock by adding the necessary chemicals and fillers to separated portions of the fresh stock.

16 Claims, 2 Drawing Sheets

STOCK FEED SYSTEM FOR A MULTI-LAYER HEADBOX AND METHOD IN THE OPERATION OF A MULTI-LAYER HEADBOX

BACKGROUND OF THE INVENTION

The invention relates to a stock feed system for a multi-layer headbox and a method in the operation of a multi-layer headbox.

In the prior art, systems for the operation of multi-layer headboxes are known in which there are separate fresh stocks for the surface layers, i.e., the two extreme layers, and for the middle layer or layers. In the prior art systems, there are at least two fresh-stock systems for the formation of both surface layers. The stocks introduced along separate fresh-stock lines, of which there are at least two, are processed in vortex cleaning and in deaeration tanks, and in the system, feeds of fillers or starch complying with the required paper grade are passed into the at least two fresh-stock lines.

OBJECTS AND SUMMARY OF THE INVENTION

It is an object of the present invention to provide a new and improved stock feed system for a multi-layer headbox and a method in the operation of a multi-layer headbox in which only one freshstock line is required.

To achieve this object and others, the invention is used in a paper machine that comprises a multi-layer headbox and therein at least two separate inlet headers or equivalent, for the inlet headers, separate stocks are prepared out of the same fresh stock and from the same stock tank. According to the invention, the fresh stock passed out of the stock tank is divided or partitioned into two or more stock component flows which are fed into the multi-layer headbox. Chemicals and/or additives purposeful for the quality or the economy of production of different paper grades are passed into these stock component flows.

In the stock system in accordance with the invention for a multi-layer headbox, a stock concept is passed into each inlet header of the multi-layer headbox which is produced out of the same fresh stock by adding the necessary chemicals and fillers to the fresh stock to provide the desired characteristics of each stock concept. Specifically, the stock system comprises means for providing a single flow of fresh stock, means for dividing or branching the single flow of fresh stock into a plurality of stock flows, means for independently adding chemicals and/or fillers to each of the stock flows, and means for passing the stock flows after the chemicals and/or fillers have been added thereto to the headbox. Preferably, the stock system has a single fresh stock tank from which a fresh stock line is led. This fresh stock line is divided at branch points into several branch lines.

In the method in accordance with the invention, the stock for each header is prepared out of one and the same fresh stock by adding the necessary chemicals and fillers to the fresh stock to provide the desired characteristics of the stock for each header. Specifically, a single flow of fresh stock is provided and is divided into a plurality of stock flows. Chemicals and/or fillers are independently added to each of the stock flows and then the stock flows are passed into a respective inlet header.

In a preferred embodiment, the single flow of fresh stock is divided into only two separate stock flows which are passed through branch lines. The branch line of a first stock flow is divided to provide stock concept for an uppermost and lowermost inlet header in the headbox while the branch line of a second stock flow provides the stock concept for a middle inlet header arranged between the uppermost inlet header and the lowermost inlet header.

The invention will be described in the following with reference to some preferred embodiments of the invention illustrated in the figures in the accompanying drawing. However, the invention is not confined to these embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
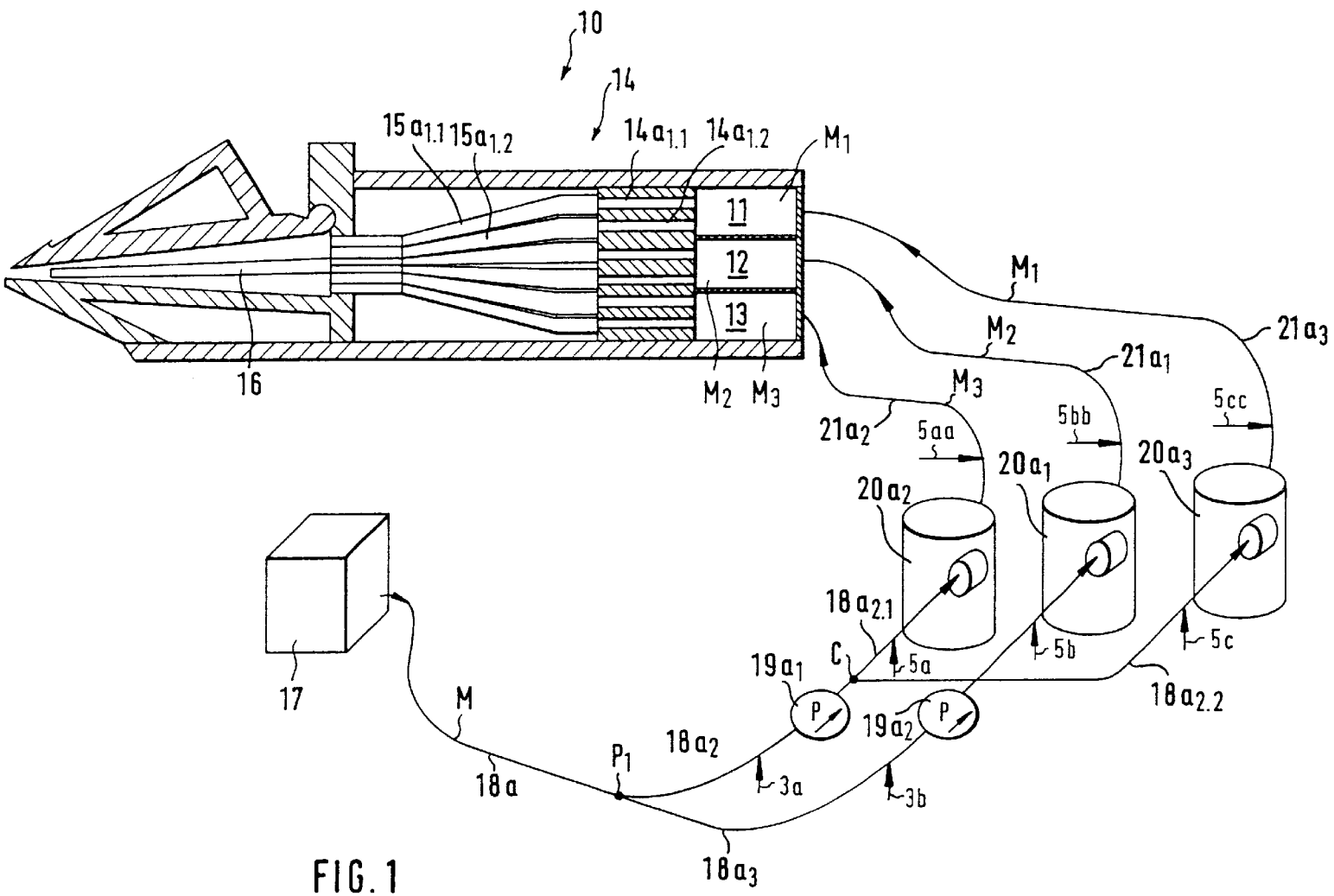
FIG. 1 is a first preferred embodiment of the invention, in which the stock flow passed out of a fresh-stock tank is divided into three component flows, which are passed further, after feeds of chemicals and fillers, into the different inlet headers in the multi-layer headbox.

Referring to the drawings wherein like reference numerals refer to the same elements, FIG. 1 is a schematic illustration of a first preferred embodiment of the invention, which is favorably suitable for the production of SC-paper. As shown in FIG. 1, a multi-layer headbox 10 comprises three inlet headers, i.e., inlet headers 11, 12 and 13. From inlet header 11, a stock $M_1$ is passed through the distribution manifold $\mathbf{14}a_{1.1}$, $\mathbf{14}a_{1.2}$, . . . to a turbulence generator 15 into turbulence tubes $\mathbf{15}a_{1.1}$, $\mathbf{15}a_{1.2}$, . . . arranged in the turbulence generator 15 and further into a slice cone 16. From inlet header 12, stock $M_2$ is passed through distribution pipes $\mathbf{14}a_{2.1}$, $\mathbf{14}a_{2.2}$, . . . of the distributor manifold 14 to the turbulence generator 15 into respective turbulence tubes $\mathbf{15}a_{2.1}$, $\mathbf{15}a_{2.2}$, . . . further into the slice cone 16. Similarly, from inlet header 13, a stock $M_3$ is passed through distribution pipes $\mathbf{14}a_{3.1}$, $\mathbf{14}a_{3.2}$, . . . of the distributor manifold 14 to the turbulence generator 15 into respective turbulence tubes $\mathbf{15}a_{3.1}$, $\mathbf{15}a_{3.2}$, . . . and further into the slice cone 16. By means of the multi-layer headbox shown in FIG. 1, a paper web is formed out of three stock concepts $M_1$, $M_2$ and $M_3$.

Thus, the web will comprise three layers formed from different stock concepts. It is possible though that there are a plurality of intermediate stock concepts forming middle layers of the web so that there would be four or more different stock concepts.

It is an important feature of the invention that the apparatus comprises a single stock system whereby the stocks $M_1$, $M_2$ and $M_3$ are formed from the same fresh stock M. In contrast to the presence of several fresh-stock lines in the prior art apparatuses, in the method and the apparatus in accordance with the invention, different layers of the web are formed from the same fresh stock M which is passed from a single fresh-stock tank 17. In the manner shown in FIG. 1, the fresh stock M is passed out of the fresh-stock tank 17 along a conduit or line 18*a* and is branched or divided at a branching point $P_1$, which is defined in a branching member, into two separate branch lines $\mathbf{18}a_2$ and

18$a_3$, each passing a separate stock component flow. In the embodiment of FIG. 1, in the branch line 18$a_2$, a chemical 3*a* is added to the stock M, and in the branch line 18$a_3$, a chemical 3*b*, such as a filler or starch or mixture thereof, is added. In the lines 18$a_2$, 18$a_3$, the stocks are made to flow further along the conduits by means of pumps 19$a_1$ and 19$a_2$, respectively, such that, along the line 18$a_2$, the stock is passed into a machine screen 20$a_1$. Retention agent 5*b* is fed into the stock before the machine screen 20$a_1$, and retention agent 5*bb* is fed into the stock after the machine screen. In this manner, an adequate mixing of the retention agent and the stock is achieved. Along the line 21$a_1$, the stock $M_2$ that was formed is passed into the middle inlet header 12 of the multi-layer headbox.

From the line 18$a_2$, after the pump 19$a_1$, from the branch point C, the line 18$a_{2.1}$ passes to a machine screen 20$a_2$, and from the machine screen 20$a_2$, the line 21$a_2$ passes to the multi-layer headbox. At the front side of the machine screen 20$a_2$, a retention agent 5*a* is fed into the line 18$a_{2.1}$, and after the machine screen 20$a_2$, a retention agent 5*aa* is fed into the line 21$a_2$. Along the line 21$a_2$, the stock flow $M_3$ is passed into the inlet header 13 of the multi-layer headbox, the lowermost therein to form the lower layer of the web.

From the branch point C, the line 18$a_{2.2}$ passes to a machine screen 20$a_3$ and further into the multi-layer headbox. Into the line 18$a_{2.2}$, before the machine screen 20$a_3$, a retention agent 5*c* is fed, and after the machine screen 20$a_3$, retention agent 5*cc* is fed. Along the line 21$a_3$, the stock flow $M_1$ is passed into the inlet header 11 of the multi-layer headbox, the uppermost therein to form the upper layer of the web.

Figure 2:
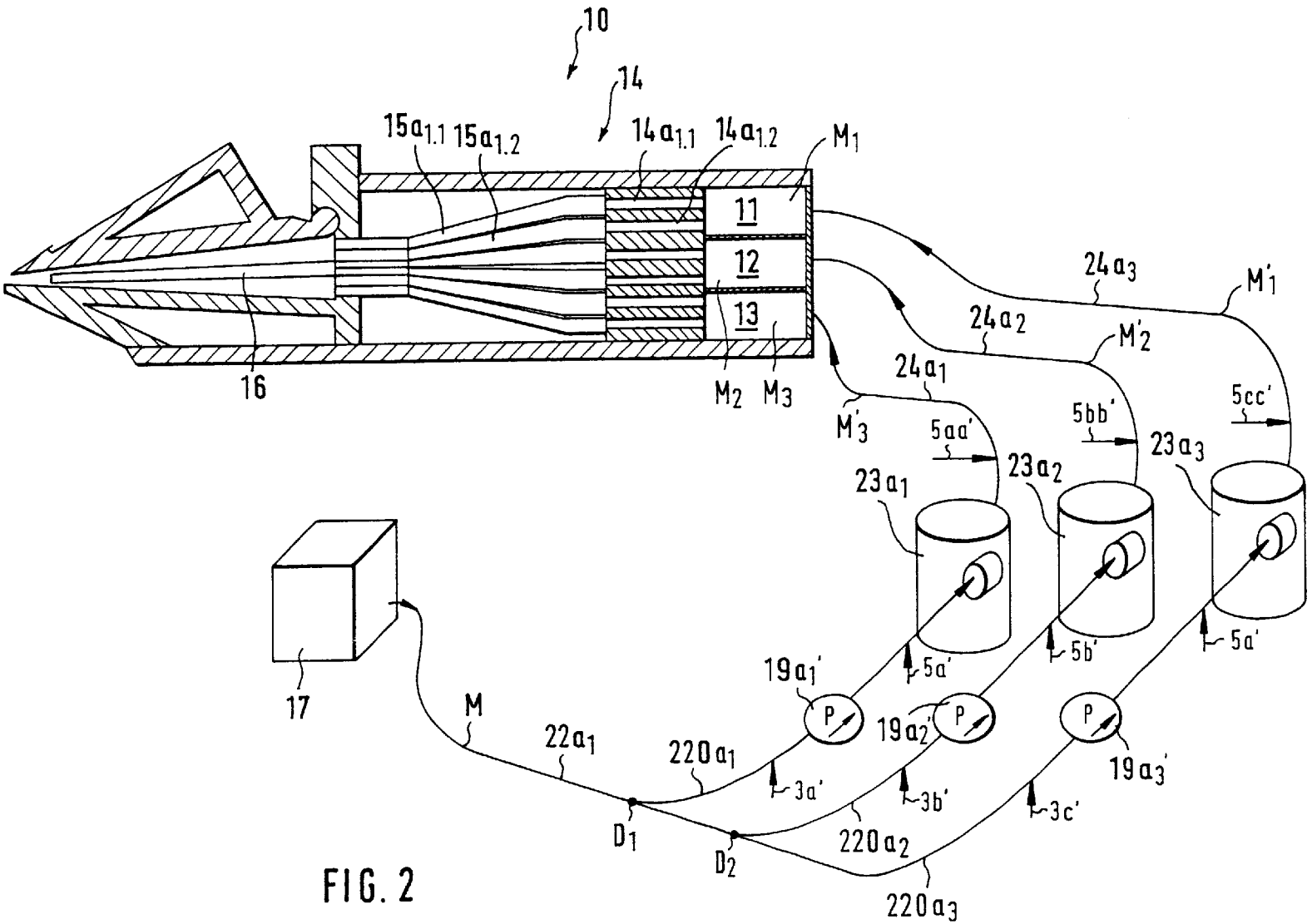
FIG. 2 is a second preferred embodiment of the stock feed system in accordance with the invention for a multi-layer headbox in which the method in accordance with the invention is applied.

FIG. 2 shows an embodiment of the invention in which one unified stock flow M is passed out of the stock tank 17 along a line 22$a_1$ to branch point $D_1$. After the branch point $D_1$, a chemical composition 3*a*' is added to the fresh stock M into a conduit or line 220$a_1$ diverging from line 22*a* at branch point $D_1$. By means of the pump 19$a_1$' the stock flow is made to flow further into a machine screen 23$a_1$. Before the machine screen 23$a_1$, a retention agent 5*a*' is added, and after the machine screen 23$a_1$, another retention agent 5*aa*' is added. The stock $M_3$' flow is passed along line 24$a_1$ into the inlet header 13 of the multi-layer headbox.

From the branch point $D_1$, the stock M continues to flow along the line 22$a_1$ to branch point $D_2$, from which the stock M is branched into two diverging lines, 220$a_2$ and 220$a_3$, each passing a separate stock flow. Into line 220$a_2$, a chemical composition 3*b*', such as filler or starch or mixture thereof, is added into the stock M before pump 19$a_2$'. By means of the pump 19$a_2$', the stock concept is passed further into a machine screen 23$a_2$. Before the machine screen 23$a_2$, a retention agent 5*b*', such as some suitable chemical, is added to the stock, and after the machine screen 23$a_2$, a retention agent 5*bb*' is added to the stock. The stock concept $M_2$' produced in this manner is passed further along line 24$a_2$ into the multi-layer headbox, into its middle inlet header 12.

Similarly, from branch point D2, the stock M is passed along the line 220$a_3$, after the feed of a chemical 3*c*' herein, by means of the circulation produced by pump 19$a_3$', into a machine screen 23$a_3$. Before machine screen 23$a_3$, a retention agent 5*c*' is added, and after which, a retention agent 5*cc*' is added. The stock concept $M_1$' thereby produced is passed further along line 24$a_3$ into the inlet header 11 of the multi-layer headbox 10.

Thus, in the concept in accordance with the invention, just a single circulation of stock is used, in which there is just one starting fresh stock M. Thus, since as shown in FIGS. 1 and 2 there is only a single fresh stock storage 17 in the stock feed system, the circulation of stock is continuous in the absence of additional storage facilities. Fresh stock M is processed further by adding chemicals and fillers to specific portions thereof to obtain the desired properties for each of the different portions, i.e., stock component flows. In this manner, from a single fresh stock M, all the necessary different stock concepts $M_1$, $M_2$ and $M_3$ are obtained for the inlet headers 11,12 and 13 of the multi-layer headbox.

It is understood that there may be more than three layers in the web. In this case, the single fresh stock line can be divided, or branch lines thereof subdivided, into as many stock flows are needed.

The examples provided above are not meant to be exclusive. Many other variations of the present invention would be obvious to those skilled in the art, and are contemplated to be within the scope of the appended claims.

What is claimed is:

1. Stock feed system in combination with a multi-layer headbox having at least two inlet headers into each of which a respective stock flow is passed and which extend in a direction transverse to a flow direction of the respective stock flow, comprising a single fresh stock storage tank, a branching member, first passage means for continuously passing a single flow of fresh stock from said single storage tank to said branching member where said single flow of fresh stock is divided into a plurality of divided stock flows without storing said single flow of fresh stock between said single fresh stock tank and said branching member, second passage means for continuously passing each of said plurality of divided stock flows from said branching member into a respective one of said at least two inlet headers in said headbox without storing said divided stock flows between said branching member and said respective inlet header, and means for independently adding chemicals and/or fillers to each of said plurality of divided stock flows during the flow of said plurality of divided stock flows after said branching member and before said plurality of divided stock flows enter into said headbox such that stock in each inlet header has an independently controllable chemical and/or filler characteristic.

2. The stock feed system of claim 1, wherein said first passage means comprise a fresh stock line and said second passage means comprises a plurality of branch lines, each of said plurality of divided stock flows being directed through one of said branch lines coupled to said fresh stock line via said branching member.

3. The stock feed system of claim 2, further comprising pumps coupled to a respective one of said branch lines for pumping said divided stock flows through said branch lines.

4. The stock feed system of claim 3, further comprising a machine screen coupled to each of said branch lines and arranged after said pumps in a flow direction, said means for independently adding chemicals and/or fillers to said divided stock flows being structured and arranged to add chemicals and/or fillers before said pumps, after said pumps and before said machine screens and after said machine screens such that each of said divided stock flows has a desired composition before being passed into the respective one of said inlet headers in said headbox.

5. The stock feed system of claim 1, wherein said fresh stock storage tank is the only stock storage tank in the stock feed system between said stock storage tank and said headbox.

6. The stock feed system of claim 1, wherein said at least two inlet headers are arranged adjacent one another within said headbox.

7. The stock feed system of claim 1, wherein said at least two inlet headers are situated vertically one above another.

8. Method for regulating properties of stock being passed into a respective one of at least two inlet headers of a multi-layer headbox, the stock flowing from said at least two inlet headers through a system of tubes and further into a slice cone, comprising the steps of:

retaining stock in a single fresh stock storage tank, continuously passing a single flow of fresh stock from said single fresh stock storage tank to a branching point in which said single flow of fresh stock is divided into a plurality of divided stock flows without storing said single flow of fresh stock between said single fresh stock tank and said branching point, continuously passing each of said plurality of divided stock flows from said branching point into a respective one of said inlet headers in said headbox without storing said divided stock flows between said branching point and said respective inlet header, and independently adding chemicals and/or fillers to each one of said plurality of divided stock flows during the flow of each of said plurality of divided stock flows after said branching point and before said plurality of divided stock flows enters into said headbox.

9. The method of claim 8, further comprising the steps of providing a plurality of branching points in said single flow of fresh stock such that said single flow of fresh stock is divided at said branching points and passed into different lines whereby one of said divided stock flows passes through a respective one of said lines, and adding a chemical into each of said lines independent of the addition of the chemical to other of said lines.

10. The method of claim 9, further comprising the step of pumping said divided stock flows through said lines via pumps.

11. The method of claim 10, further comprising the steps of coupling a machine screen to each of said lines after said pumps in a flow direction, and adding chemicals and/or fillers before said pumps, after said pumps and before said machine screens and after said machine screens.

12. The method of claim 8, further comprising the steps of dividing said single flow of fresh stock into only two separate flows at said branching point, passing said two flows through branch lines, further dividing said branch line of a first one of said two flows to provide stock concept for an uppermost and lowermost inlet header in the headbox, respectively and passing a second one of said two flows into a middle inlet header arranged between the uppermost inlet header and the lowermost inlet header.

13. The method of claim 8, wherein said fresh stock storage tank is the only stock storage tank in the stock feed system between said stock storage tank and said headbox.

14. The method of claim 8, wherein said at least two inlet headers are arranged adjacent one another within said headbox.

15. The method of claim 8, wherein said at least two inlet headers are situated vertically one above another.

16. A combination of a multi-layer headbox including inlet headers and a stock feed system for feeding stock to the inlet headers of the multi-layer headbox, the stock feed system comprising a single fresh stock tank for retaining stock, a branching member, a first flow line having first and second opposed ends, said first end of said first flow line being connected to said single fresh stock tank and said second end of said first flow line being connected to said branching member, a single flow of fresh stock being passed through said first flow line from said single fresh stock tank to said branching member and being divided in said branching member into a plurality of stock flows without storing said single flow of fresh stock between said single fresh stock tank and said branching member, at least second and third flow lines each having first and second opposed ends and through each of which a respective one of said divided stock flows passes, said first ends of said second and third flow lines being connected to said branching member and said second ends of said second and third flow lines leading to a respective one of said inlet headers of said headbox, a respective one of said divided stock flows being passed through respective ones of said second and third flow lines from said branching member without storing said divided stock flows between said branching member and said inlet headers, and means for independently adding chemicals and/or fillers to each of said divided stock flows during the flow of said divided stock flows through a respective one of said at least second and third flow lines after said branching member and before entry of said divided stock flows into said inlet headers such that stock in each inlet header has an independently controllable chemical and/or filler characteristic.

* * * * *